US005886328A

United States Patent [19]

Yun

[11] Patent Number: 5,886,328

[45] Date of Patent: Mar. 23, 1999

[54] COOKING CHAMBER CAVITY STRUCTURE OF MICROWAVE OVENS

[75] Inventor: Ji-Tae Yun, Suwon, Rep. of Korea

[73] Assignee: Samsung Electronics Co., Ltd., Suwon, Rep. of Korea

[21] Appl. No.: 898,407

[22] Filed: Jul. 22, 1997

[30] Foreign Application Priority Data

Aug. 20, 1996 [KR] Rep. of Korea ..... U.M. 96-24990 U

[51] Int. Cl.[6] ..... H05B 6/80

[52] U.S. Cl. ..... 219/756

[58] Field of Search ..... 219/756, 757; 126/273 R

[56] References Cited

U.S. PATENT DOCUMENTS 4,609,801 9/1986 Spencer et al. ..... 219/756

FOREIGN PATENT DOCUMENTS 0 110 364 6/1984 European Pat. Off. ..... 219/756

60-243428 12/1985 Japan ..... 219/756

60-245930 12/1985 Japan ..... 219/756

*Primary Examiner*—Philip H. Leung

*Attorney, Agent, or Firm*—Burns, Doane, Swecker & Mathis, L.L.P.

[57] ABSTRACT

A body structure of a microwave oven having a cooking chamber for cooking foods includes an electronic part mounting member for mounting electronic parts thereon, a partition wall formed with the electronic part mounting member in one body therewith, and a bottom plate arranged at one side of the partition wall, thereby covering the cooking chamber at a bottom position thereof.

3 Claims, 3 Drawing Sheets

COOKING CHAMBER CAVITY STRUCTURE OF MICROWAVE OVENS

BACKGROUND OF THE INVENTION

1. Field of the Invention

The present invention relates to a microwave oven and, in particular, to a cooking chamber cavity structure for microwave ovens.

2. Description of the Prior Art

A conventional microwave oven, as illustrated in FIGS. 1 and 2, includes: a partition wall 5 formed in a "U" shape for partitioning off the microwave oven into a cooking chamber 1 and a machine room 3; a top plate 6 disposed at an upper side of the partion wall 5 for covering a cooking chamber; a rear panel 7 assembled at one side of the partition wall 5 to house the cooking chamber 1 and the machine room 3; a front panel 9 disposed at the other side of the partion wall 5; and a bottom plate 11 placed beneath a bottom of the partition wall 5, thus supporting the bottom of the partition wall 5 and at the same time, mounted thereon with various electronic parts.

The front panel 9 is formed at one side thereof with an opening 9*a* for receiving foods therethrough into the cooking chamber 1. The front panel 9 formed with the opening 9*a* is provided at one side thereof a door member 13, thereby opening or closing the cooking chamber 1. The cooking chamber is removably mounted at a floor thereof with a turntable 15 for placing foods thereon.

The machine room 3 is mounted at one side thereof with a high frequency generating means 17 for generating a high voltage. The machine room is also provided at one side thereof with a magnetron 19 for generating a high frequency when a high voltage generated by the high frequency generating means 17 is applied thereto.

The magnetron 19 and the partition are assembled at their upper sides with a waveguide 21 for guiding high frequency produced by the magnetron into the cooking chamber. The rear panel 7 is provided at one side thereof with a fan 23, which allows air to flow into and to be discharged outside the microwave oven after circulation of the air therein when electric power is supplied thereto, thereby cooling an inner side of the microwave oven.

Furthermore, a lateral wall of the cooking chamber 1 is formed at an upper side thereof with a number of outlets 5*a* for serving to discharge the air therethrough after its circulation. The front panel 9 is disposed at a side of the machine room with an exterior duct 25 for discharging the air infused into the machine room 3 toward a kitchen.

The exterior duct 25 is mounted at above a control unit 27 provided with a manipulating button, by which a driving condition, heating time and the like are selected.

In order to drive the microwave oven thus constructed, first, the door 13 is opened and food F is placed on the turntable disposed on the floor of the cooking chamber 1, thereafter the door 13 is closed, desired cooking time and cooking menu and the like are input by the control unit 27, and a start button is pressed. Then the turntable 15 is rotated in one direction as a high frequency is generated according to an oscillating operation of a magnetron (not shown) to thereafter be dispersed in the cooking chamber 1.

The high frequency dispersed in the cooking chamber 1 is reflected from metal walls therein and is radiated to the food on the turntable 15 to thereby heat the food.

At this time, a heat generated by operations of the high frequency generating means 17 and magnetron 19 is cooled by an exterior air flowing into the machine room 3 through a number of inlets 7*a* formed in the rear panel 7 when the fan 23 is operated by electric power applied thereto, and the air is discharged through the exterior duct 25 outside the oven thereafter.

Meanwhile, some exterior air sucked through the inlet 7*a* formed at the rear panel 7 flows into the cooking chamber 1 and cool the heated air, thereafter being discharged toward the outside the oven through a number of outlets 5*a* formed at an upper side of the wall of the cooking chamber 1.

However, there is a problem in the conventional microwave oven thus constructed in that as the cooking chamber cavity structure requires five parts, that is, the partition wall 5, the top plate 6, the front panel 9, the rear panel 7, and the bottom plate 11 to form the cooking chamber 1, the cavity structure wastes material and increases the manufacturing cost.

SUMMARY OF THE INVENTION

Accordingly, the present invention is provided to solve the aforementioned problem and it is an object of the present invention to provide a cooking chamber cavity structure for microwave ovens, in which a partition wall formed by bending is provided and serve to mount electronic parts thereon, thereby reducing the number of parts of the cavity structure and reducing the manufacturing cost of the cavity structure.

In order to accomplish the above object, the present invention provides a cooking chamber cavity structure for microwave ovens comprising a partition wall for partitioning off into a cooking chamber and a machine room and for having an electronic part-mounting member for allowing electronic parts to mount thereon; and a bottom plate disposed one side of the partition wall, thereby enclosing the bottom side of the cooking chamber.

BRIEF DESCRIPTION OF THE DRAWINGS

For a fuller understanding of the nature and objects of the invention, reference should be made to the following detailed description taken in conjuction with the accompanying drawings, in which.

DETAILED DESCRIPTION OF A PREFERRED EMBODIMENT OF THE INVENTION

Figure 1:
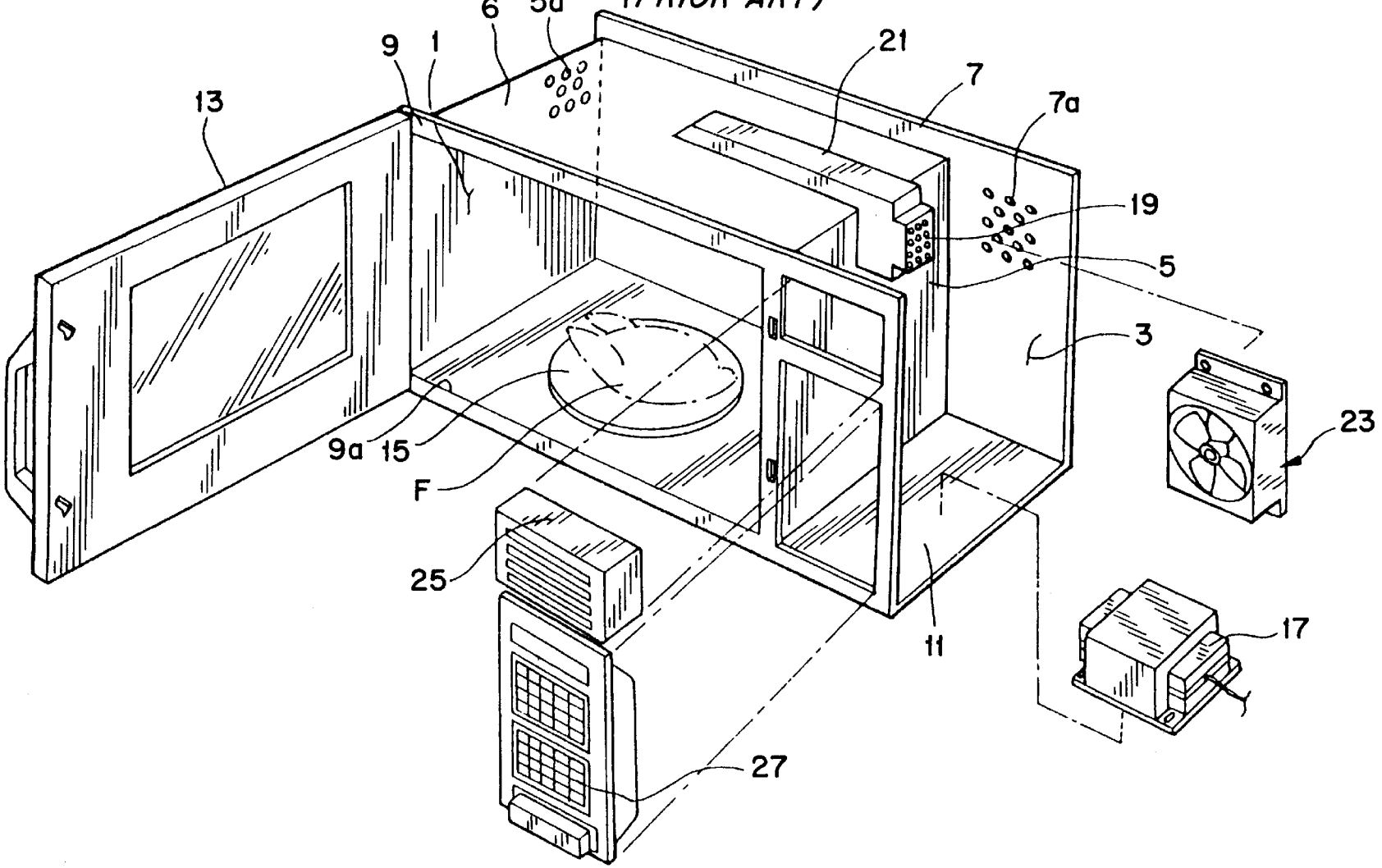
FIG. 1 (PRIOR ART)
FIG. 1 is an exploded perspective view for illustrating of a microwave oven structure according to the prior art.
Figure 2:
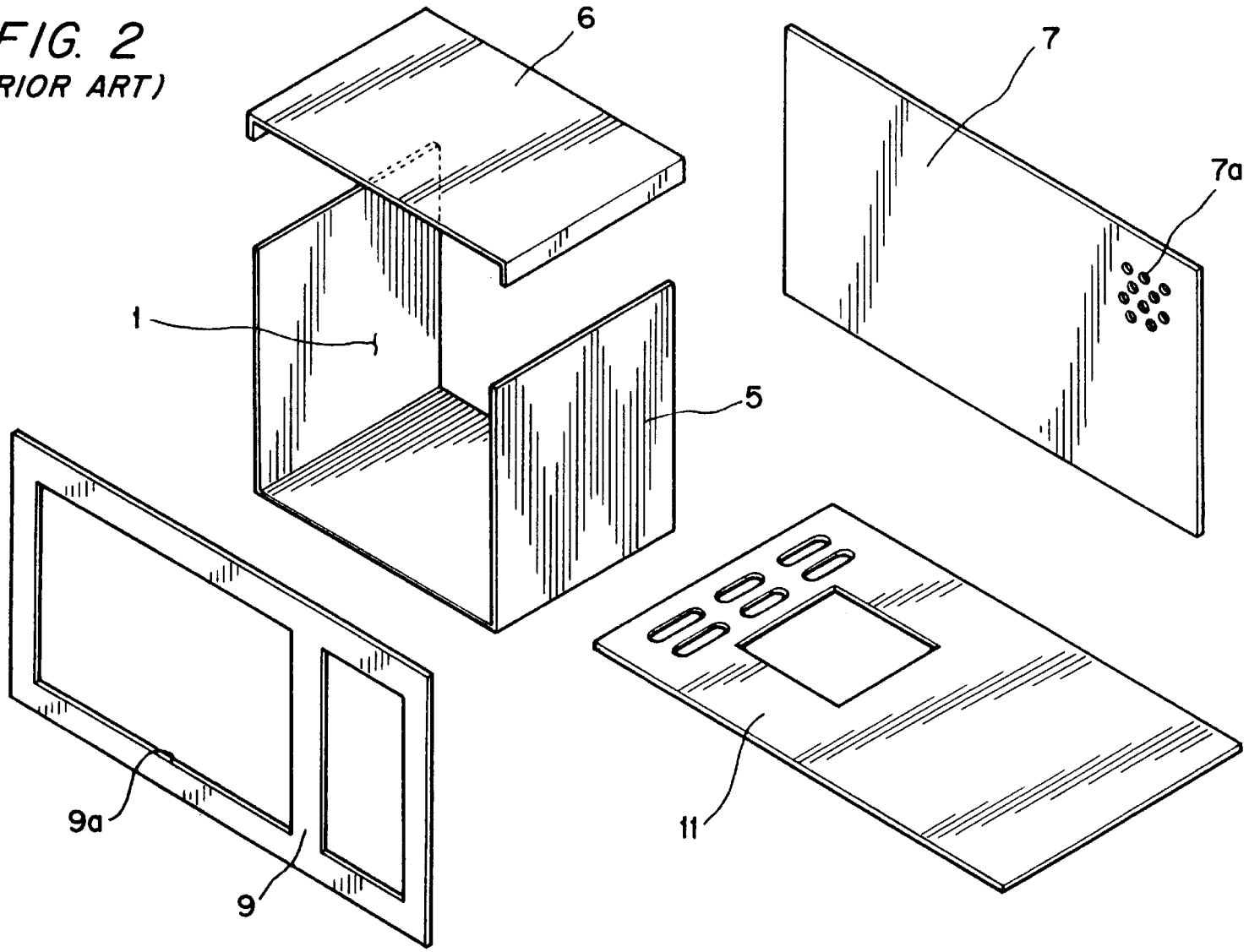
FIG. 2 (PRIOR ART)
FIG. 2 is an exploded perspective view for illustrating a cavity structure of a microwave oven according to the prior art.

An embodiment of the present invention will now be described in detail with reference to the accompanying drawings. Throughout the drawings, like reference numerals and symbols are used for designation of like or equivalent parts or portions for simplicity of illustration and explanation, and redundant reference will be omitted.

Figure 3:
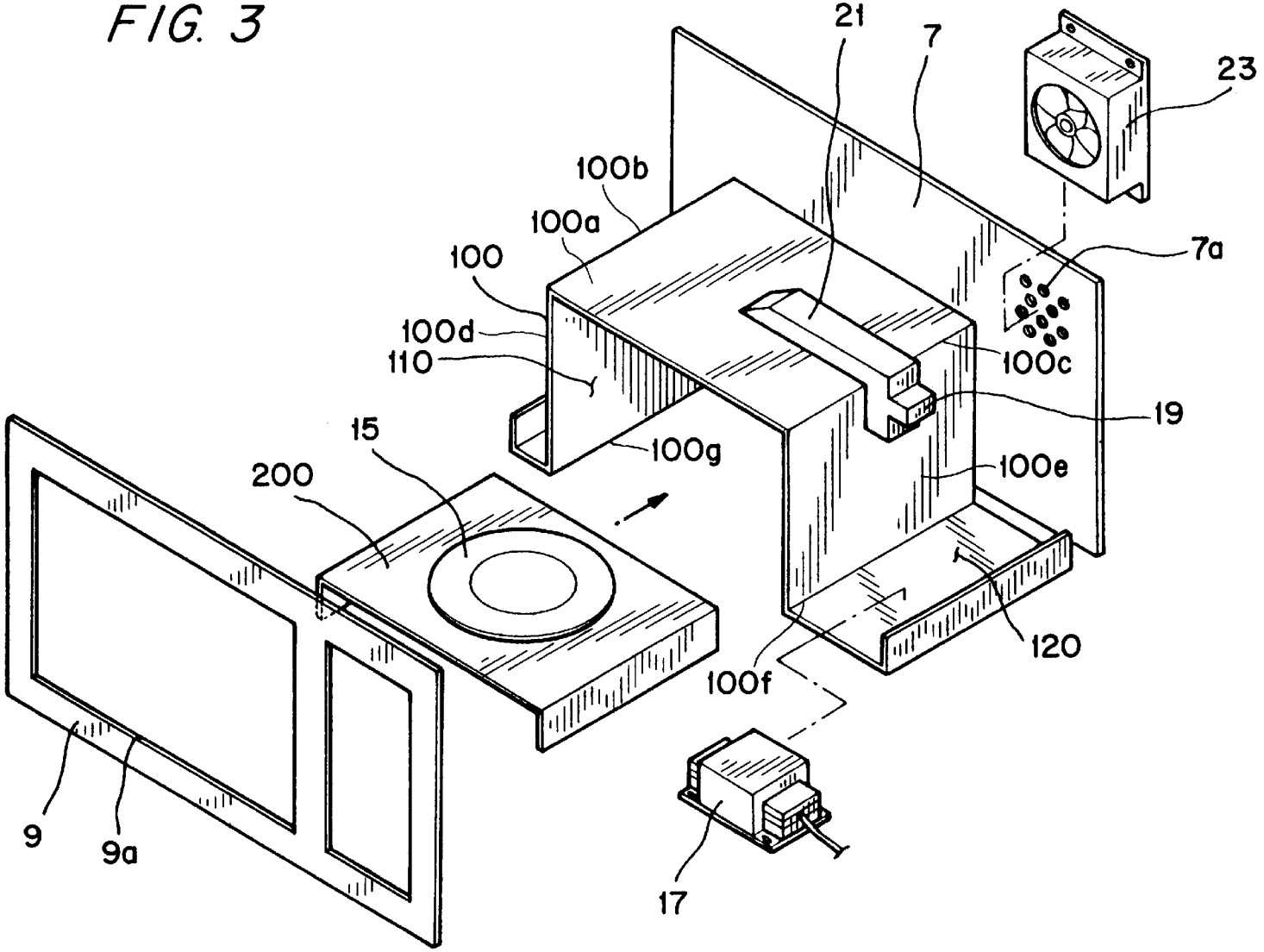
FIG. 3 is an exploded perspective view for illustrating a cavity structure of a microwave oven according to the present invention.

The cooking room cavity or body structure according to an embodiment of the present invention, as illustrated in FIG. 3, includes a partition wall 100 provided with an electronic part mounting member 120 to allow electronic parts to be mounted thereof and, at the same time, for serving to form the cooking chamber 110 at the other side thereof, and a bottom plate 200 for covering the bottom side of the partition wall 100, thereby forming the cooking chamber 110.

The partition wall 100 forms a top 100*a* of the cooking chamber and is bent vertically along opposing edges 100*b*, 100*c* of that top to form sides 100*d*, 100*e* of the cooking chamber 110. The wall 100 is bent horizontally away from the cooking chamber along a lower edge 100*f* of the side 100*e* to form the mounting member 120 which constitutes a bottom of an electronic parts compartment. The side 100*e* separates the cooking chamber from the electronic parts compartment. The wall 100 is also bent horizontally away from the cooking chamber at a location 100*g* defined by a lower edge of the side 100*d*.

The partition wall 100 is arranged at a front side thereof with a front panel 9 formed with an opening 9*a* of the cooking chamber 110, and at the same time, covering a front side of the cooking chamber 110.

The partition wall 100 is arranged at one side thereof with a rear panel 7 to cover a rear side of the cooking chamber 110.

The partition wall 100 is provided at an upper side thereof with a magnetron 19 for generating a high frequency, and is arranged at a top plate thereof with a waveguide 21 to allow high frequency generated by the magnetron to flow into the cooking chamber 110.

The electronic part mounting member 120 is provided thereon with a high frequency generating means for supplying electric power of a high voltage to the oven.

A fan 23 is arranged at an upper side of the high frequency generating means 17 in order to force an exterior air to flow into the oven, to thereby cool a heat generated when the oven is operated.

The rear panel 7 is formed at one side thereof with a plurality of inlets 7*a* to allow an exterior air to flow into the inner side of the oven. The bottom plate 200 is removably provided at an upper surface thereof with a turntable 15 for placing foods thereon.

Next, the operation of the cooking chamber cavity structure of a microwave oven according one embodiment of the present invention thus constructed will be described.

In order to assemble the cooking chamber cavity structure, first, the bottom plate 200 is inserted into the inner side of the partition wall 100, which houses the cooking chamber 110 and has the electronic part mounting member 120 formed in an "U" shape by a bending process, thereby forming the cooking chamber 110; the high frequency generating means is mounted to the electronic part mounting member 120; the magnetron 19 and the waveguide 21 are assembled to the upper side of the partition wall 100; and the rear panel 7 is disposed at the rear side of the partition wall 100 and the front panel 9 is assembled to the front side of the partition wall 100 thereafter.

As the micrwave oven thus constructed has the partition wall 100 formed in one body with the electronic part mounting member 120, the present invention reduces the number of parts, improves the workability in assembling and saves money in the material.

What is claimed is:

1. A body structure of a microwave oven having a cooking chamber and an electronic parts compartment, comprising:

a partition wall forming a horizontal top of a cooking chamber and being bent vertically at first and second locations defining opposing edges of the top to form two sides of the cooking chamber, the two sides projecting downwardly from respective ones of the two opposing edges of the top, the partition wall being bent horizontally away from the cooking chamber at a third location defining a bottom edge of one of the two sides to form a horizontal bottom of the electric parts compartment, whereby the one side separates the cooking chamber from the electronic parts compartment, and a horizontal bottom plate mounted at lower portions of the two sides to form a bottom of the cooking chamber.

2. The body structure according to claim 1 further comprising a vertical rear panel attached to a rear of the partition wall to form a back of the cooking chamber and a back of the electronic parts compartment, and a vertical front panel attached to a front of the partition wall to form a front of the cooking chamber and a front of the electronic parts compartment.

3. The body structure according to claim 2 wherein the partition wall is bent horizontally away from the cooking chamber at a fourth location defined by a lower edge of the other of the two sides.

* * * * *